340-566
5/27/86 OR 4,591,834

United States Patent [19]

Kyle

[11] Patent Number: 4,591,834

[45] Date of Patent: May 27, 1986

[54] INTRUSION DETECTING APPARATUS WITH ZONE IDENTIFICATION AND WITH NOISE INTERFERENCE DISCRIMINATION

[75] Inventor: William F. Kyle, Los Gatos, Calif.

[73] Assignee: Argus Systems, Inc., Los Gatos, Calif.

[21] Appl. No.: 555,213

[22] Filed: Nov. 25, 1983

[51] Int. Cl.[4] ..... G08B 13/22

[52] U.S. Cl. ..... 340/566; 340/518; 340/534; 340/825.13; 340/825.49

[58] Field of Search ..... 340/566, 518, 524, 507, 340/870.26, 825.13, 825.49, 534, 531

[56] References Cited

U.S. PATENT DOCUMENTS

| | | | |
|---|---|---|---|
| 3,774,190 | 11/1973 | Kyle, Jr. | 340/258 R |
| 3,913,085 | 10/1975 | Farstad | 340/566 |
| 4,342,986 | 8/1982 | Buskirk et al. | 340/531 |
| 4,374,378 | 2/1983 | Lee | 340/518 |
| 4,517,554 | 5/1985 | Moser et al. | 340/518 |

OTHER PUBLICATIONS

Portable Seismic System, published by Intrusion Detection Systems, Inc., Oct. 1981.

*Primary Examiner*—Glen R. Swann, III
*Attorney, Agent, or Firm*—Jack M. Wiseman

[57] ABSTRACT

Apparatus for detecting the presence of intruders includes a plurality of sensors. The apparatus not only operates an alarm to indicate the presence of an intruder, but, also, identifies the location in which the intrusion has occurred. There are two groups of sensors at each discrete location or zone. One group of sensors detects the presence of an intruder by the activation of one or more sensors. Another group of sensors discriminates against externally generated sounds to reduce false alarms. In the preferred embodiment, both groups of sensors utilize the same cable. An intrusion detection multiplexer and a discriminator multiplexer are employed to enable the sensors of each zone respectively to be sequentially detected and identified through the same apparatus.

21 Claims, 9 Drawing Figures fig_2
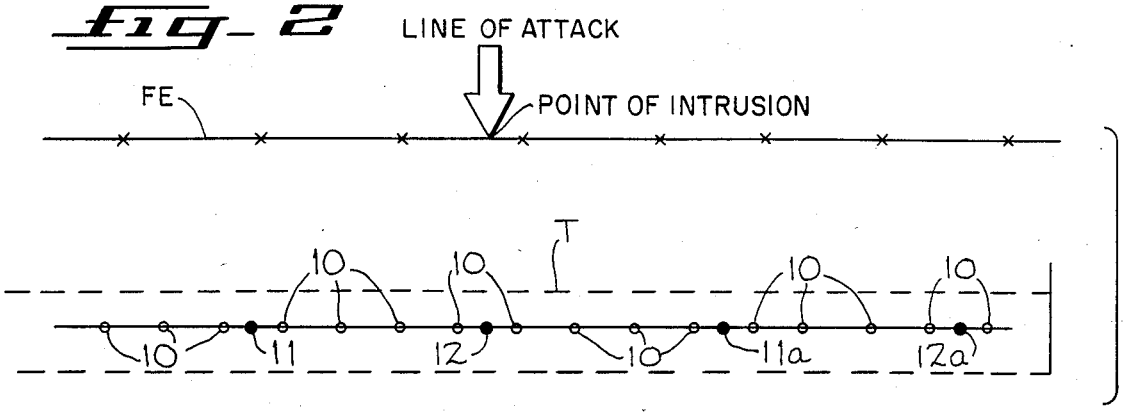
fig_3
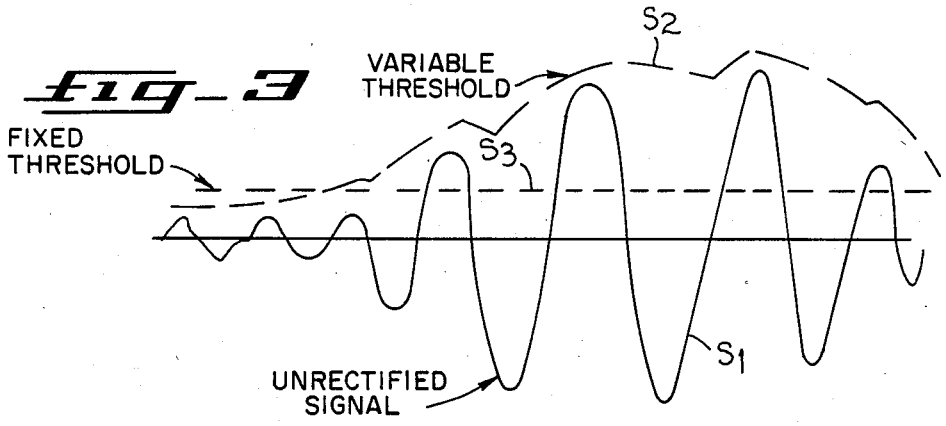
fig_4
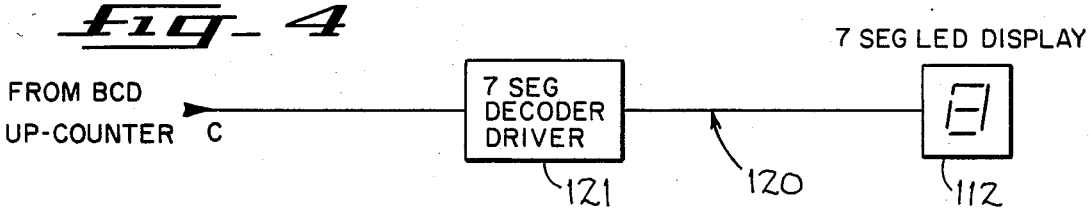
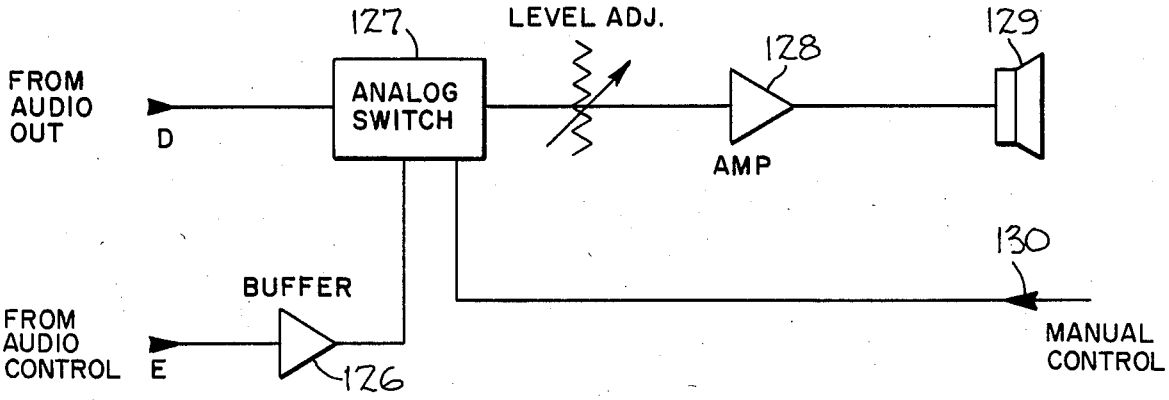
fig_5

INTRUSION DETECTING APPARATUS WITH ZONE IDENTIFICATION AND WITH NOISE INTERFERENCE DISCRIMINATION

BACKGROUND OF THE INVENTION

The present invention relates in general to apparatus for detecting the presence of an intruder, and more particularly to apparatus that detects the presence of an intruder, identifies the location in which the intrusion is detected and discriminates against noise interference to reduce false alarms.

In the patent to William F. Kyle, Jr., U.S. Pat. No. 3,774,190, issued on Nov. 20, 1973, for Intrusion Alarm With Signal Processing And Channel Identification, there is disclosed intrusion detection apparatus. The intrusion detection apparatus comprises a plurality of groups of sensors. Each group of sensors is located in a discrete area. Sensors are activated to detect the presence of an intruder and to identify the zone of the intrusion.

Intrusion Detection Systems, Inc. of San Leandro, Calif., manufactures a seismic system SSP-1 to SSP-12 in which detector sensors are activated to transmit seismic signals to a signal processor for the operation of an alarm. Discriminator sensors are employed to screen or cancel unwanted noises to reduce false alarms. The detector sensors are operated off one bus and the discriminator sensors are operated off another bus.

SUMMARY OF THE INVENTION

One or more intrusion detection sensors is activated to signal the presence of an intruder. At least two discriminator sensors are simultaneously activated to reduce false alarms from noise interference. The activation of two discriminator sensors simultaneously prevents an intruder from inadvertently advancing over a single discriminator sensor and thereby entering a zone undetected.

A feature of the present invention is that the intruder detection sensors and the discriminator sensors are connected to the same cable to reduce cable costs and trenching costs.

Another feature of the present invention is the employment of a multiplexer for the intrusion detection sensing and the employment of a discriminator multiplexer for the noise discrimination sensing. The employment of the multiplexers has been found to reduce the cost of installation of the apparatus embodying the present invention. The sensors of a plurality of zones or discrete locations can be respectively detected and identified through the same apparatus.

DESCRIPTION OF THE DRAWINGS

FIG. 2 is a diagrammatic illustration of an arrangement for the location of intrusion detection sensors for the intrusion detection and of the location of discriminator sensors for the detection of noise interference to reduce false alarms employed in the intrusion detection apparatus of the present invention.

FIG. 3 is a graphical illustration of the waveforms of threshold detection signals employed in the intrusion detection apparatus of tne present invention.

FIG. 4 is a block diagram of a zone display circuit employed in the intrusion detection apparatus of the present invention.

FIG. 5 is a block diagram of an audio listen-in circuit employed in the intrusion detection apparatus of the present invention.

DESCRIPTION OF THE PREFERRED EMBODIMENT

Figure 1:
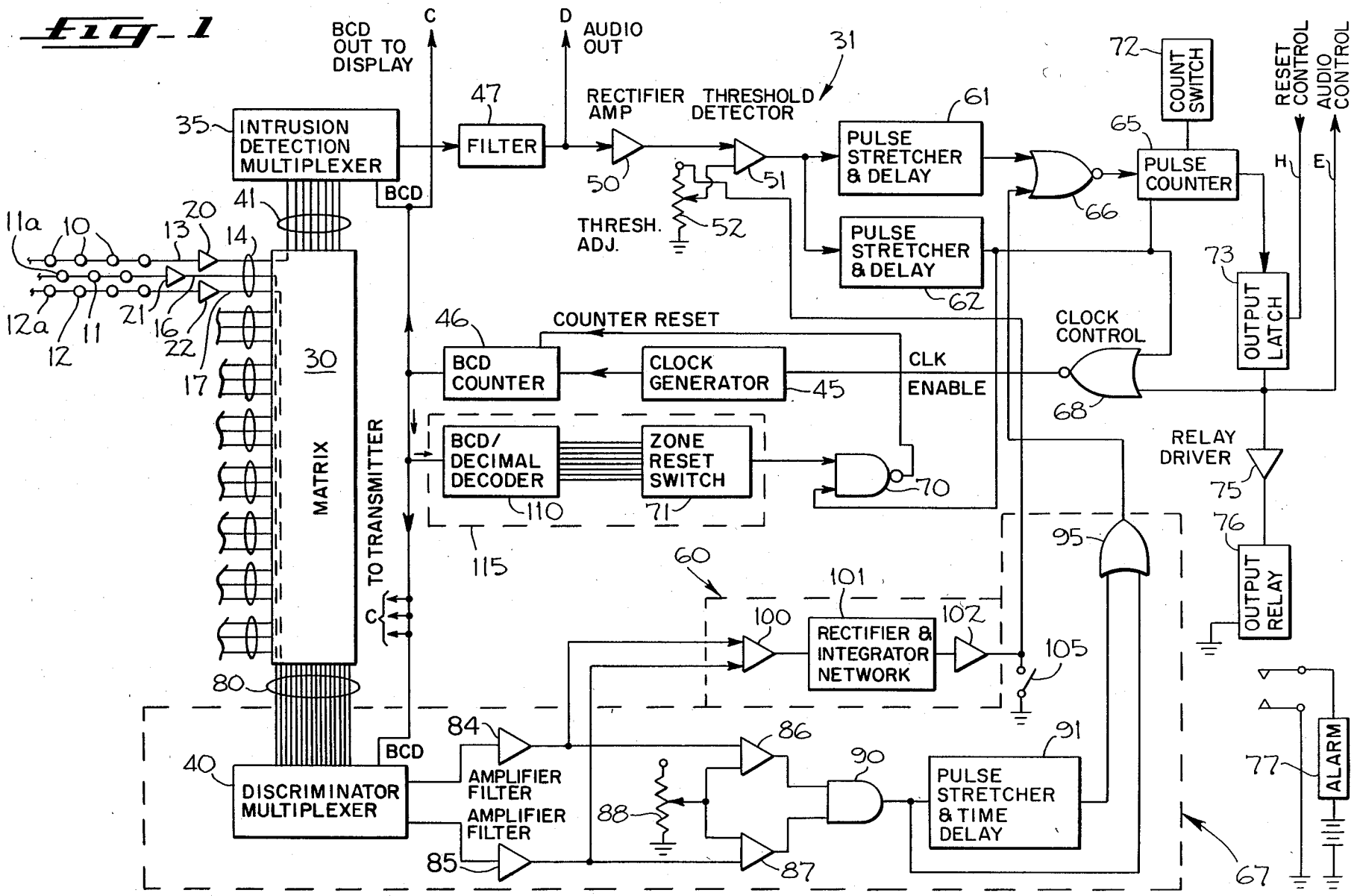
FIG. 1 is a block diagram of a signal processing circuit employed in the intrusion detection apparatus of the present invention.

Illustrated in FIGS. 1 and 2 are a plurality of well-known seismic sensors or geophones herein referred to as intrusion detection sensors 10. The intrusion detection sensors 10 are connected to a signal line 13 of a cable 14. Well-known seismic sensors or geophones are herein referred to as discriminator sensors 11, 12, **11*a* and 12*a*. The discriminator sensors 11 and 11*a* are connected to a signal line 16 of the cable 14 and the discriminator sensors 12 and 12*a* are connected to a signal line 17 of the cable 14. In the exemplary embodiment, the sensors 10, 11, 11*a*, 12 and 12*a* are miniature low frequency dynamic microphones. Each sensor generates its own signal or signals and does not require any external source of power. The sensors respond to variations in the ambient or background sounds and are activated by such variations in the ambient or background sounds to produce output signals. The output signal or signals emanating from the intrusion detection sensors are applied to a matrix 30 of a signal processor 31 (FIG. 1) over a conductor 13 via a pre-amplifier 20. The output signal or signals emanating from the discriminator sensors 11 and 11*a* are applied to the matrix 30 over the conductor 16 through a pre-amplifier 21 and the output signal or signals emanating from the discriminator sensors 12 and 12*a* are applied to the matrix 30 over the conductor 17 through a pre-amplifier 22. Each pre-amplifier, such as pre-amplifiers 20–22**, includes a voltage divider, not shown, for biasing the output signals. In this manner, each output signal has an offset level so that both positive and negative excursions of the input signal will be present in the output.

A variety of patterns may be employed for the location of sensors. Sensors may be aligned in a single or double line for perimetric detection or may be aligned in clusters for corridor or area detection. In FIG. 2, an exemplary embodiment shows a single line of sensors disposed in a trench T for perimetric detection below a fence FE. The spacing between successive intrusion detection sensors 10, in the preferred embodiment, is twelve feet and the spacing between successive discriminator sensors 11, 12, **11*a* and 12*a*, in the preferred embodiment, is thirty to fifty feet (FIG. 2). The arrangement of sensors illustrated in FIG. 2 constitutes a single zone. Thus, the activation of the sensors 10 in FIG. 2** identifies the location or zone of intrusion for the discrete area or zone shown in FIG. 2.

The matrix 30 (FIGS. 1 and 9) directs the incoming signals emanating from any one or more of the intrusion detection sensors 10 to an intrusion detection multiplexer 35 of the signal processor 31 and directs the incoming signals emanating from any one or more of the discriminator sensors 11, 12, 11*a* and 12*a* to a discriminator multiplexer 40 of the signal processor 31. The matrix 30 includes d.c. bias circuits 30' and 30'' (FIG. 9) to establish uniform minimum signal magnitude for directing signals to the multiplexers 35 and 40 for reducing transient noises resulting from shifts in signal levels.

The multiplexers 35 and 40 are manufactured by National Semiconductor Corporation as CD4051 and CD4052, respectively. The intrusion detection multiplexer 35 is in the form of an electronic analog switch, which electronically steps in succession or scans a plurality of conductors 41. In the preferred embodiment, there are eight conductors 41 (FIG. 9) and hence, arrays of intrusion detection sensors for eight different zones may be processed in the apparatus of the present invention. The array of intrusion detection sensors for one particular zone is illustrated in FIG. 2. The successive stepping or scanning is at a clock rate to sample successively incoming intrusion detection signals for each zone respectively over the conductors 41. In the preferred embodiment, the clock rate at which the intrusion detection multiplexer 35 advances in succession from incoming conductor to incoming conductor of the conductors 41 for sampling or testing the incoming intrusion detection signals is from 1 $H_z$ to 500 $H_z$.

A conventional clock generator 45 produces pulses of 4 $H_z$ to 2 $KH_z$. The output of the clock generator 45 is applied to a BCD up counter 46. In turn, the clock pulses from the output of the counter 46 is applied to the intrusion detection multiplexer 35 for electronically stepping the multiplexer 35 at the aforementioned clock rate.

Incoming intrusion detection signals advancing over the conductors 41 are applied in succession via the intrusion detection multiplexer 35 through a suitable filter 47 to an amplifier circuit 50. The selection of the filter 47 is dependent on the band of frequencies causing interference noises, such as transformers, pumps, compressors or the like. It is within the contemplation of the present invention to include bandpass filters at various stages in the intrusion detection processing circuit.

The circuit 50 amplifies the incoming signals, rectifies the incoming signal to a full wave d.c. pulse and shapes the full wave d.c. pulses to reduce spurious interfering signals within the intrusion detection processing circuit 31. The circuit 50 is a conventional full wave rectifier and amplifier.

The output of the circuit 50 is applied to a threshold detector 51. The threshold detector 51 advances only those signals exceeding a predetermined voltage. Toward this end, a variable resistor 52 is manually set to provide a fixed reference voltage or bias for the threshold detector 51. In the alternative, a variable d.c. threshold voltage may be applied to bias or set a variable reference d.c. voltage for the threshold detector 51 by means of a variable threshold control circuit 60.

When a rectified signal from the circuit 50 applied to the threshold detector 51 exceeds the threshold voltage, an output pulse signal is applied to a pulse stretcher and time delay circuit and to a pulse stretcher and time delay circuit 62. The pulse stretcher and tin'e delay circuits 61 and 62 are well-known retriggerable monostable multivibrators.

The pulse stretcher and time delay circuit 61 delays the advancement of pulse signals to inhibit multiple rapid pulse signal through a NOR gate 66 from accumulating in a pulse counter 65. The output of the pulse stretcher and time delay circuit 61 passes through the NOR gate 66 to the input of the pulse counter 65. The other input of the NOR gate 66 is connected to a discriminator processing circuit 67 of the signal processing circuit 31 to reduce false alarms in a manner to be described hereinafter. In the event the discriminator circuit 67 has been activated by the activation of two discriminator sensors, then the NOR gate 66 inhibits the passing of output pulses through the NOR gate 66.

The time delay for the pulse stretcher and time delay circuit 62 is greater than the time delay for the pulse stretcher and time delay circuit 61. The output of the retriggerable pulse stretcher and time delay circuit 62 enables for a greater period of time the operation of the pulse counter 65 in response to the pulses passing through the NOR gate 66 from the pulse stretcher and time delay circuit 61. The monostable multivibrator circuit 62 is retriggerable so that each input pulse extends the "on" time by the circuit time constant. The pulse stretcher and time delay circuit 62 is activated by the same event or pulse at the same time as the pulse stretcher and time delay circuit 61 is activated, but provides a greater time period for the pulses advancing through the pulse stretcher and time delay circuit 61 and the NOR gate 66 to be counted by the pulse counter 65.

In addition thereto, the pulse stretcher and time delay circuit 62 is connected to a NOR gate 68. A pulse from the output of the pulse stretcher and time delay circuit 62 passing through the NOR gate 68 disables the clock generator 45 to discontinue the application of stepping pulses to the intrusion detection multiplexer 35. This action inhibits the intrusion detection multiplexer 35 from advancing to the succeeding incoming conductor of the conductors 41 after the detection of an intruder noise by an intrusion detection sensor 10. The period of time that the intrusion detection multiplexer 35 is inhibited from advancing to the succeeding conductbr of the conductors 41 is the same period of time in which the pulse counter 65 is enabled by the pulse stretcher and time delay circuit 62 for the counting of pulses passing from the pulse stretcher and time delay circuit 61 through the NOR gate 66. It is to be observed that the BCD code output from the BCD counter 46 is correlated with the scanning of the intrusion detection multiplexer 35. As a consequence thereof, the scanning by the intrusion detection multiplexer 35 is discontinued and the last BCD code in the output of the BCD counter remains when the processing circuit 31 is in an alarm mode to identify the zone in which the intrusion is detected.

Further, the pulse stretcher and time delay circuit 62 sends a pulse to one input of an NAND gate 70 to inhibit the application of a counter reset pulse to the BCD up-counter 46 from the zone reset switch 71. The pulse counter 65 produces an output signal for application to an output latch 73 after a predetermined number of pulses are applied thereto through the NOR gate 66 during the time period the pulse counter 66 is enabled by the pulse stretcher and time delay circuit 62. The application of the pulse output from the pulse counter 65 to the latch circuit 73 changes the state of the latch circuit 73 to place the signal processor 31 in the alarm mode.

A manually adjusted switch 72 is provided to select the number of pulses counted by the pulse counter 65 before the pulse counter 65 applies a signal to the output latch 73. Connected to the output of the output latch 73 is a relay driver 75. When an output signal is applied to the relay driver 75 from the output latch 73, the relay driver 75 energizes an output relay 76. The energization of the relay 76 closes the contacts to operate an alarm 77 located in the area of the intrusion detection sensors 10 to deter a trespasser and/or to alert those responsible for responding to an alarm. The output latch 73 is also connected to the input terminal of the clock control NOR gate 68 so that an intrusion or event detected by an intrusion detection sensor 10 will disable the clock generator 45 either during the time the output latch 73 is activated or during the time delay period of the pulse stretcher and time delay circuit 62. The disabling of the clock generator 45 discontinues the application of stepping pulses to the intrusion detection multiplexer 35. This action inhibits the intrusion detection multiplexer 35 from advancing to the succeeding incoming conductor of the conductors 41.

Should successive discriminator sensors, i.e. 11, 12 or 11*a*, 12*a*, be activated within a relatively short time period, such as by an external disturbance, then the circuit 67 for preventing false alarms will be activated. Examples of such external disturbances are trucks, aircraft, thunderstorms or the like. More specifically, the discriminator sensor 11 is activated and at a relatively short time period thereafter, the discriminator sensor 12 is activated. Under such conditions, the circuit 67 for preventing false alarms is activated.

The discriminator multiplexer 40 is, in the exemplary embodiment, in the form of a dual sensing electronic analog switch which scans or steps electronically and in unison in a dual switch manner a plurality of pairs of conductors 80 such as conductors 16 and 17. The discriminator multiplexer 40 samples in a dual switch manner successive incoming discriminator signals over pairs of incoming conductors of the plurality of conductors 80. For example, the signals emanating from the sensors 11 and 12 (or the sensors 11*a* and 12*a*) will appear in the conductors 16 and 17, respectively. In the preferred embodiment, the clock rate at which the dual electronic switches of the discriminator multiplexer 40 advance in succession from a pair of incoming conductors to the succeeding pair of incoming conductors is from 1 $H_z$ to 500 $H_z$. The clock pulses are applied to the discriminator multiplexer 40 from the clock generator 45. The clock rate for sequentially stepping the discriminator multiplexer 40 is at the clock rate from 4 $H_z$ to 2 $KH_z$.

Figure 9:
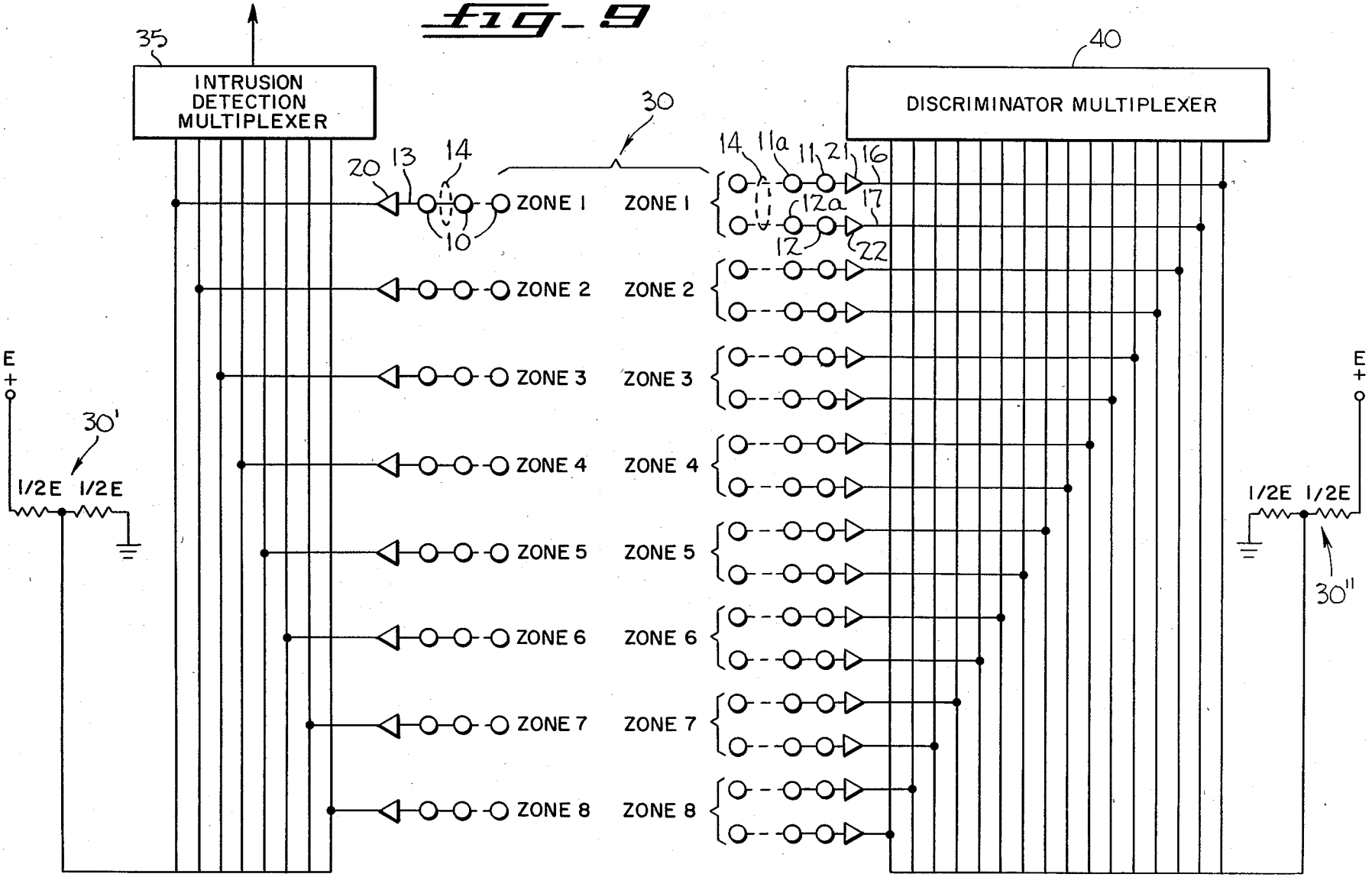
FIG. 9 is a schematic diagram of a matrix employed in the apparatus of the present invention illustrated with connecting sensors, pre-amplifiers and multiplexers to illustrate the arrangement to accommodate eight intrusion detection zones or discrete locations.

In the preferred embodiment, there are eight pairs of conductors 80 and, hence, arrays of discriminator sensors for eight different zones may be processed in the apparatus of the present invention (FIG. 9). The array of discriminator sensors for one particular zone is illustrated in FIG. 2. The two output discriminator signals from the discriminator multiplexer 40 are applied, respectively, to circuits 84 and 85, which reject extraneous noise that produces false alarms. The circuits 84 and 85 are conventional circuits which include bandpass amplifiers and filters.

The output pulse signals of the circuits 84 and 85 are applied, respectively, to threshold detectors 86 and 87. The threshold detectors 86 and 87 advance, respectively, only those signals exceeding a predetermined voltage. A variable resistor 88 is manually adjusted to provide a fixed reference voltage or bias for the threshold detectors 86 and 87.

The output signals of the threshold detectors 86 and 87 are applied to an AND gate 90. When a rectified signal from the amplifier 84 is applied to the threshold detector 86 and exceeds the threshold voltage, an output pulse is applied to one input of the AND gate 90. When a rectified signal from the amplifier 85 is applied to the threshold detector 87 and exceeds the threshold voltage, an output pulse is applied to the other input of the AND gate 90. The simultaneous application of pulse signals to the input of the AND gate 90 produces a pulse to trigger a monostable multivibrator pulse stretcher and time delay circuit 91.

The time delay of the pulse stretcher and time delay circuit 91 is greater than the time delay of either the pulse stretcher and time delay circuit 61 or the pulse stretcher and time delay circuit 62 to provide an overlap in time between the discriminator signal and the intrusion detection signal. The output of the pulse stretcher and time delay circuit 91 is applied to one input of an OR gate 95. The other input of the OR gate 95 is connected to the output of the AND gate 90. A pulse signal from either the output of the pulse stretcher and time delay circuit 91 or the AND gate 90 advances a pulse through the OR gate 95 to inhibit the NOR gate 66 from advancing intrusion detection pulses to the pulse counter 65 in a manner heretofore described. The pulse signal through the OR gate 95 inhibits pulses from advancing through the NOR gate 66 to the pulse counter 65 during the time the circuit 67 has been activated.

The overlap of the discriminator signal and the intrusion detection signal is provided to reduce false alarms arising out of subsurface reflections which may reach the intrusion detection sensors 10 after the detection of the discriminator signals from the discriminator sensors 11, 12, 11*a* and 12*a*.

The OR gate 95 reduces false alarms by inhibiting the NOR gate 66 from advancing intrusion detection pulses to the pulse counter 65 either during the sensing of a transient disturbance or noise by the discriminator sensors 11 and 12, 11*a* and 12*a*. The transient disturbance or noise will appear as a constant noise by the discriminator sensors 11, 12 (or the discriminator sensors 11*a* and 12*a*). The pulse stretcher and time delay circuit 91 is a retriggerable monostable multivibrator. Hence, a constant high level noise or disturbance above the threshold level will produce a pulse in the output of the pulse stretcher and time delay circuit 91 for advancing through the OR gate 95 to disable the NOR gate 66. Such a noise may result from a tractor plowing a field in the vicinity of the sensor line 13. Discriminator signals above the threshold level appearing in succession within the time delay period will produce in the output of the AND gate 90 a pulse to disable the OR gate 95. When a pulse does not advance through the OR gate 95, the NOR gate 66 is enabled for the advancement of intrusion detection pulses.

The output pulse signals of the amplifiers 84 and 85 are also applied to a summing amplifier circuit 100 of the variable threshold control circuit 60. Connected to the output of the sumxing amplifier circuit 100 is a rectifier and integrator network 101 of the variable threshold control circuit 60. Connected to the output of the circuit 101 is a d.c. amplifier 102 of the variable threshold control circuit 60, which produces in the output thereof an amplified, rectified variable threshold signal. The alternating summed amplifier signal S1 (FIG. 3) in the output of the summing amplifier circuit 100 is rectified and integrated by the circuit 101 to provide a rectified variable threshold signal in the output of the circuit 101. The rectified variable threshold signal, which is amplified by the amplifier 102, appears as an amplified, rectified variable threshold signal S2 (FIG. 3). The adjusted threshold signal that appears across the variable resistor 52 for establishing a d.c. bias or reference voltage for the threshold detector 51 appears as signal S3 in FIG. 3.

As heretofore described, the intrusion detection threshold detector 51 (FIG. 1) is either biased by a d.c. reference voltage established by the adjustment of the variable resistor or by a variable d.c. reference or bias voltage established by the variable threshold control circuit 60. A switch 105 is closed to disable the variable threshold control circuit 60. In such an event, the fixed reference voltage or bias established by the adjustment of the variable resistor 52 provides the threshold voltage for the threshold detector 51. When the switch 105 is opened, the variable threshold control circuit 60 establishes the variable threshold voltage for the threshold detector 51 which is superimposed on the fixed d.c. threshold voltage. The switch 105 is generally open in a noise environment. The resulting envelope of the amplified, rectified variable threshold signal S2 is adjusted to compensate for interfering background noises that may be detected by the intrusion detection sensors 10.

The variable d.c. threshold voltage S2 modifies the fixed d.c. threshold voltage for the threshold detector 51 to cause a constant differential between the low seismic signal and the threshold voltage for the threshold detector 51. This action prevents outside signals with a slow onset, such as an approaching vehicle, airplane, wind or the like either from saturating the intrusion detection processing or from inducing false alarms. This action also serves to enhance the sensitivity of the apparatus, since the threshold voltage of the intrusion detection threshold voltage 51 can be set closer to the signal envelope with fewer false alarms.

As previously described, the clock generator 45 is disabled either during the time period of the pulse stretcher and time delay circuit 62 or during the time the output latch 73 is activated. The disabling of the clock generator 45 discontinues the application of stepping pulses to the intrusion detection multiplexer 35 to inhibit the intrusion detection multiplexer 35 from advancing to the succeeding incoming conductor of the conductors 41.

In addition thereto, the disabling of the clock generator 45 discontinues the application of stepping pulses to the intruder discriminator multiplexer 40. This action inhibits the discriminator multiplexer 40 from advancing to the succeeding pair of incoming conductors of the conductors 80.

At the same time, the disabling of the clock generator 45 discontinues the application of BCD counter pulses from the BCD counter 46 to a BCD counter/decimal decoder 110. Hence, the pulses from the BCD/decimal decoder 110 to the zone reset switch 71 are discontinued. The BCD/decimal decoder 110 and the zone reset switch 71 constitute a zone reset circuit 115.

The zone reset circuit 115 is used to reduce idle time in the scanning operations. If only four zones are in use, the zone reset switch 71 can be manually set to return the BCD counter 46 to zone 1 after zone 4 has been scanned. The last BCD code that was active before the clock generator 45 was disabled remains on the BCD conductors. As a consequence thereof, a location or zone display circuit 120 (FIG. 4) is activated to indicate the location or the zone of the intrusion. The location or zone display circuit 120 is located in the general vicinity of the signal processor or the alarm output devices. The last BCD code in the output of the BCD counter 46 that was active before the clock generator 45 was disabled identifies the zone in which the intrusion had occurred.

For this purpose, the zone display 120 includes a 7-segment decoder/driver circuit 121. The 7-segment decoder/driver circuit 121 receives the BCD signal applied to the multiplexers 35 and 40 via the terminal C (FIGS. 1 and 4) and applies a location signal to a 7-segment light emitting diode display 122 to display the location or zone of the intruder detection sensors that were activated.

An audio listen-in circuit 125 (FIG. 5) is connected to the output of the filter 47 (FIG. 1) through its analog switch 127 (FIG. 5). The activation of an intrusion detection sensor 10 causes the intrusion detection multiplexer 35 to apply a signal through the filter 47 by way of the terminal D (FIGS. 1 and 5) to the analog switch 127. When the analog switch 127 is enabled, the signal from the intrusion detection multiplexer 35 is applied to a speaker driver amplifier 128 via the terminal D and the analog switch 127. Thereupon, the speaker driver amplifier 128 applies the intrusion sound signal to a suitable audio speaker 129. In the event it is desired to constantly monitor the activation of the intrusion detection sensors 10, a manual control switch 130 is actuated to enable the analog switch 127.

The analog switch 127 is enabled when the output latch 73 (FIG. 1) changes its state by the action of the pulse counter 65. The output latch 73 is activated when the signal processor 31 is in an alarm mode. Toward this end, a signal is transmitted to a buffer amplifier 126 (FIG. 5) via a terminal E (FIGS. 1 and 5), which signal is applied to an analog switch 127 to enable the analog switch 127. The analog switch 127 is enabled by the audio control signal on the terminal E, which is applied to the buffer amplifier 126. In the preferred embodiment, the sensors 10 are geophones that function as microphones. The audio signals from the sensors 10 advance through the analog switch 127, through the amplifier 128 and the speaker 129 to reproduce the sound detected by the sensors 10. When the clock generator 45 is disabled, which occurs when the intruder signal exceeds the threshold voltage, the audio signal passes through the analog switch 127. The listen-in circuit 125 enables the intrusion noise to be heard by the parties responsible for responding to an authorized intrusion.

Figure 6:
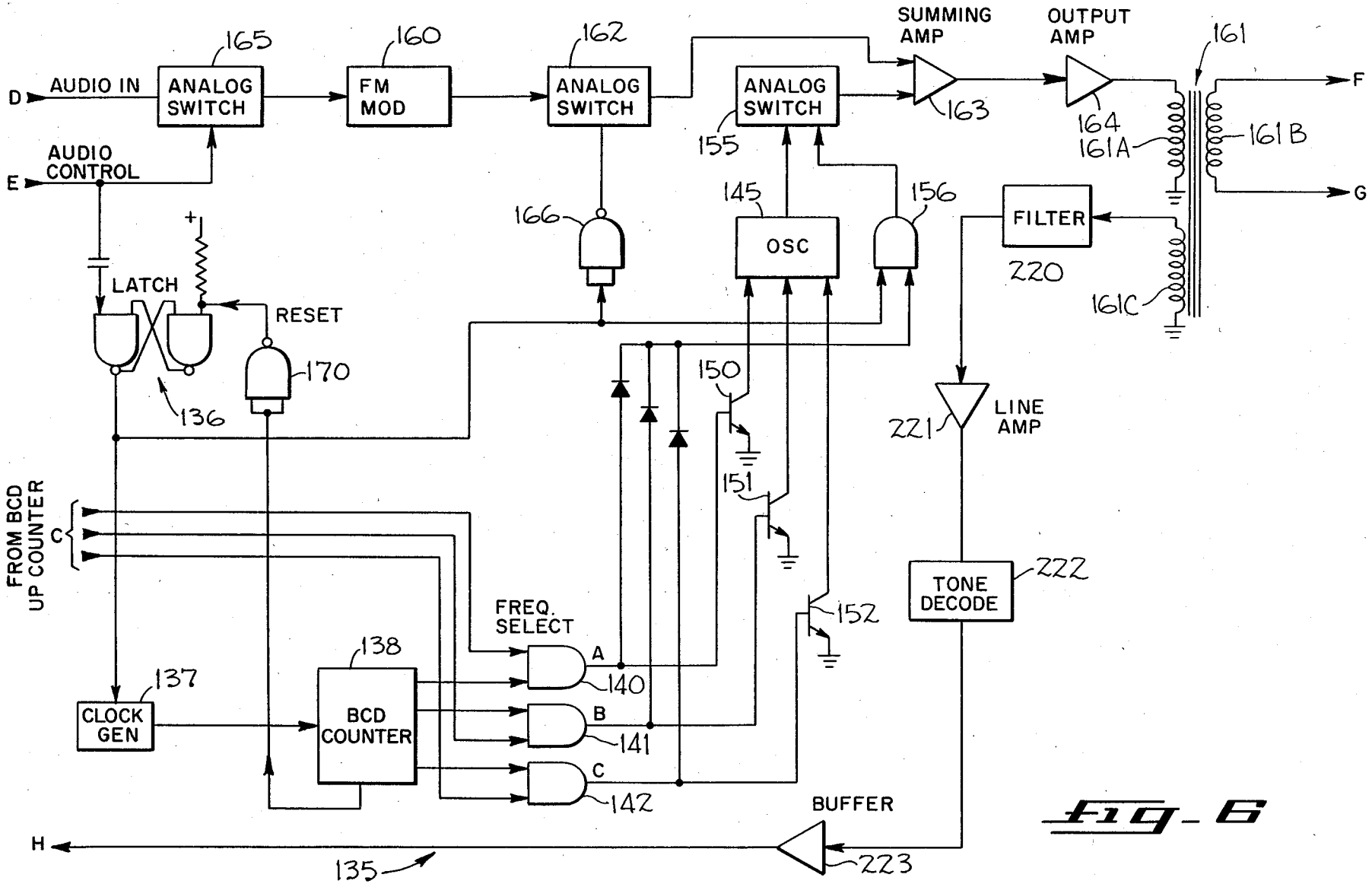
FIG. 6 is a block diagram of a transmitter of a communication link employed in the intrusion detection system of the present invention.

Illustrated in FIG. 6 is an audio alarm and zone location transmitting circuit 135 of a communication link. The audio alarm and zone location transmitting circuit 135 transmits an alarm and location data to a distant location by means of a suitable communication link, such as telephone lines, cables, r.f. links or the like.

Figure 8:
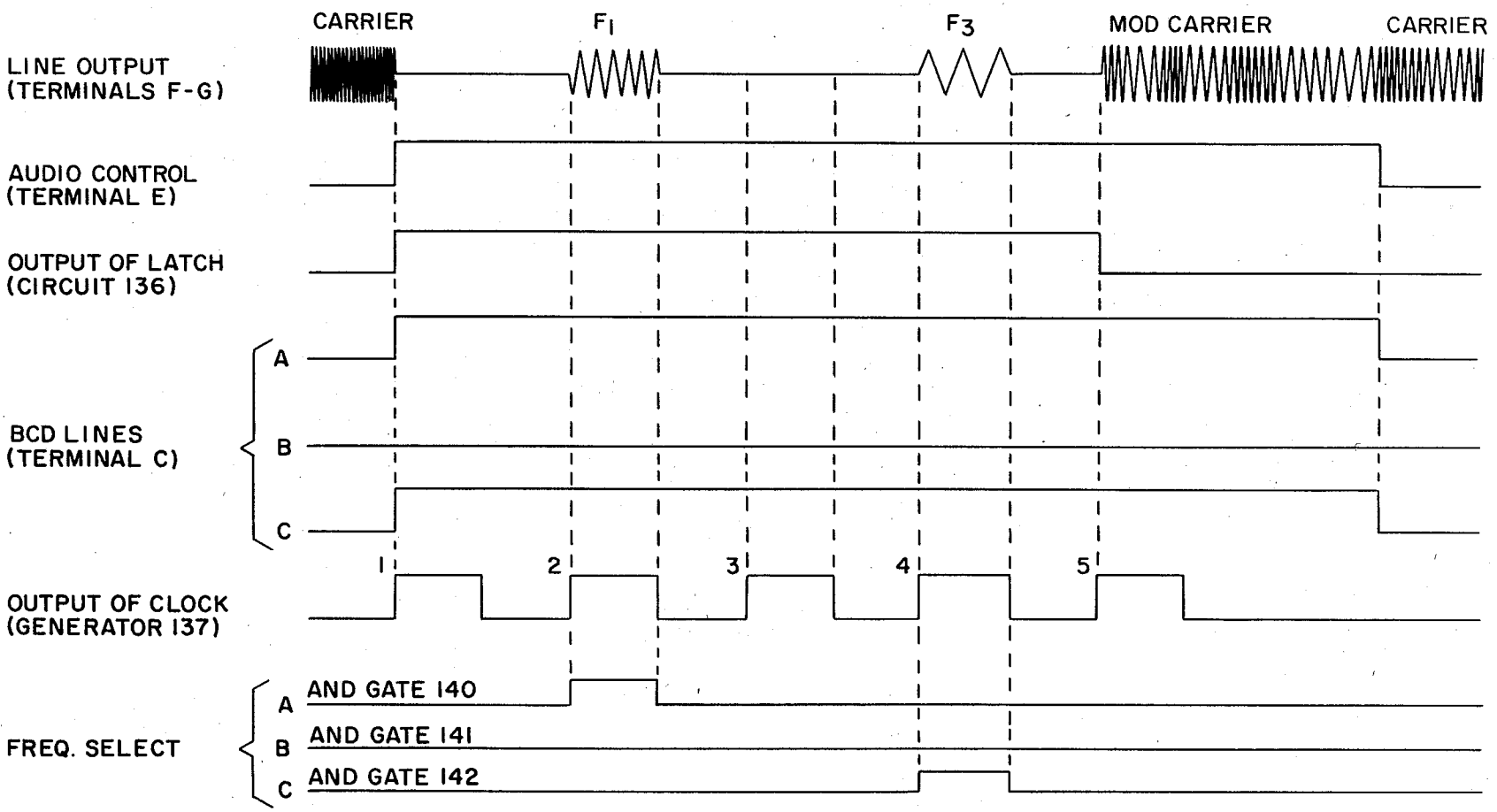
FIG. 8 is a graphical illustration of the transmitted waveforms.

During the quiescent or no alarm mode, a carrier (FIG. 8) is produced by a conventional FM modulator 160. The carrier is not modulated during the quiescent mode and advances over the following path: analog switch 162, summing amplifier 163 and output amplifier 164. Connected to the output of the amplifier 164 is the primary winding 161A of an output transformer 161.

The secondary winding 161B of the output transformer 161 applies the unmodulated carrier appearing thereacross to the terminals FG (FIGS. 6 and 7) for transmission across the communication link.

The carrier generated by the FM modulator 160 is always present for transmission across the secondary winding 161B of the output transformer 161. When the signal processor 31 is in a quiescent or no alarm mode, the unmodulated carrier provides a supervisory signal. In the event the carrier generated by the FM modulator 160 is interrupted, the signal appearing across the secondary winding 161B of the output transformer 161 represents an alarm mode.

When the signal processor 31 (FIG. 1) is in the alarm mode, the output latch 73 (FIG. 1) changes its state in a manner previously described. When the output latch 73 changes its state, the audio control signal (FIG. 8) is applied to a latch circuit 136 (FIG. 6) via the terminal E (FIGS. 1 and 6).

The audio control signal from the activated latch circuit 73 changes the state of the latch circuit 136. The change of state of the latch circuit 136 disables the analog switch 162 through the NAND gate 166. In addition, the change of state of the latch circuit 136 excites a clock generator 137. The excitation of the clock generator 137, in turn, applies clock pulses (FIG. 8) to a BCD counter 138 (FIG. 6). The clock generator 137 produces square wave pulses at a frequency of 0.5 $H_z$. The output of the BCD counter 138 enables the frequency selection AND gates 140–142.

The BCD signals (FIG. 8) applied to the AND gates 140–142 via the terminal C (FIGS. 1 and 6) constitute the BCD code for representing the location or zone signal. The BCD signals representing the location or zone signal are present in the output of the BCD counter 46 (FIG. 1) at the time the clock generator 45 (FIG. 1) is disabled by the presence of an alarm mode in the signal processor 31. The BCD signals from the signal processor 31 appearing on the terminal C (FIGS. 1 and 6) are applied to the other input conductors of the enable frequency selection AND gates 140–142. The BCD code is generated by the BCD counter 46

Connected to the frequency selection AND gates 140–142 through suitable transistors 150–152 is a suitable oscillator 145. The frequency selection AND gates 140–142 selected for conduction by the BCD code signals select the zone frequencies $F_1$, $F_2$ and $F_3$ (FIG. 8) generated by the oscillator 145. Connected to the output of the oscillator 145 is one input of an analog switch 155. The control input of the analog switch 155 is connected to the output of an AND gate 156. When the audio control signal changed the state of the latch circuit 136, the analog switch 155 was enabled through the AND gate 156. The excitation of the enabled oscillator 145 by the selective conduction of the frequency selection AND gates 140–142 produced a zone or location frequency or frequencies over the following path: analog switch 155, summing amplifier 163, and output amplifier 164. Thus, zone or location frequency or frequencies in the output of the output amplifier 164 is transmitted over the communication link through the secondary winding 161B of the output transformer 161. At this time, the analog switch 162 is disabled in a manner previously described.

During an alarm mode, the audio control signal enables an analog switch 165 (FIG. 6) via the terminal E (FIGS. 1 and 6). The audio signal emanating from the activated intrusion detection sensors 10 advances through the intrusion detection multiplexer 35 (FIG. 1) by way of the terminal D (FIGS. 1 and 6). The audio signal from the activated intrusion sensors 10 advances through the enabled analog switch 165 and is applied to the input of the FM modulator 160.

When the BCD counter 138 (FIG. 6) is stepped to the output 5 terminal, for example, by the output pulses of the clock generator 137, the latch circuit 136 is reset through a reset NAND gate 170. The resetting of the latch circuit 136 enables the analog switch 162 through the NAND gate 166. The carrier frequency generated by the FM modulator 160 is frequency modulated by the audio signal advancing through the enabled analog switch 165. The frequency modulated carrier appearing in the output of the FM modulator 160 advances through the enabled analog switch 162, the summing amplifier 163, and the output amplifier 164. The frequency modulated carrier (FIG. 8) is transmitted from the output transformer 161 through the communication link.

Figure 7:
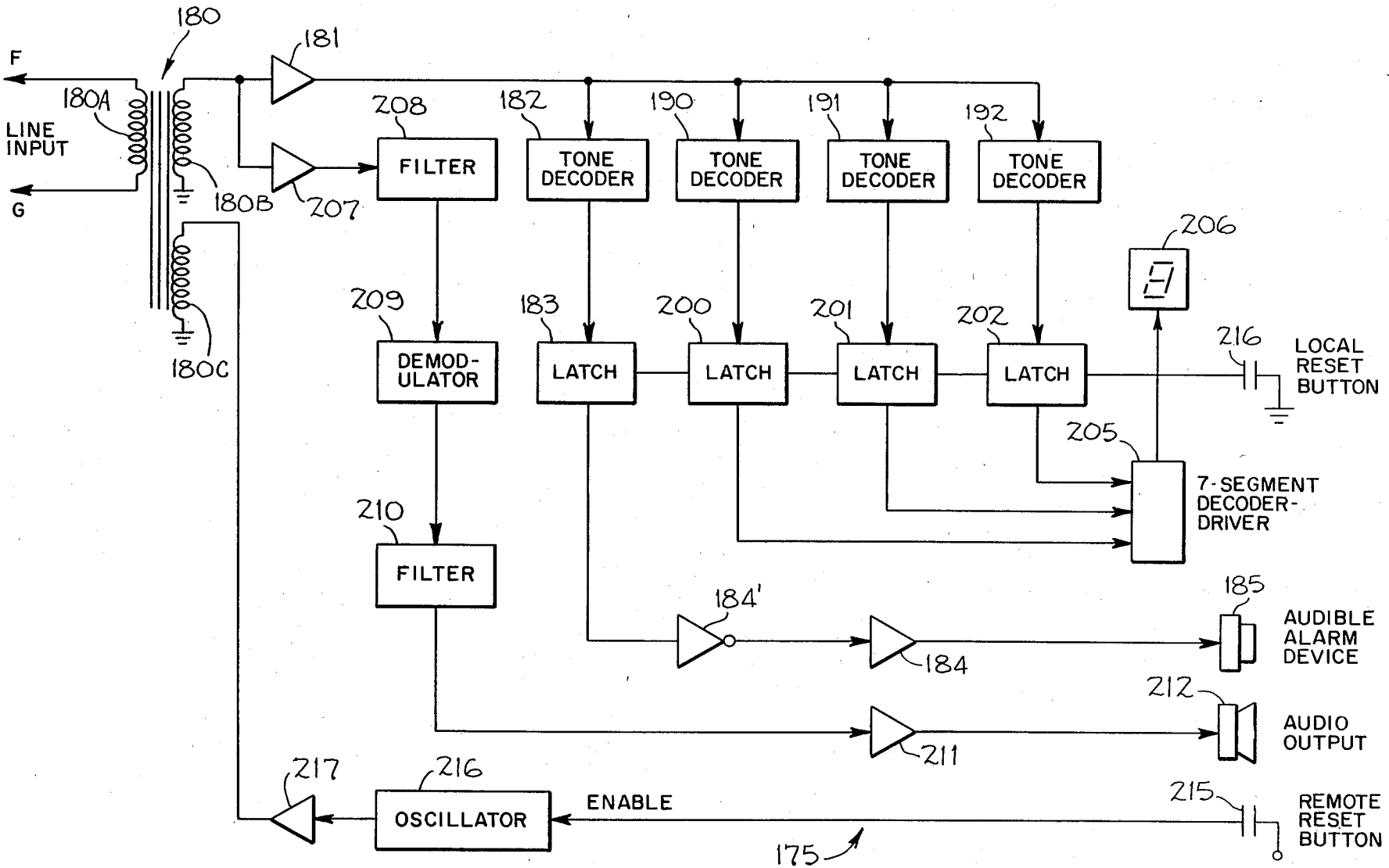
FIG. 7 is a block diagram of an audio display and audio alarm circuit for a receiver of the communication link responsive to the transmission of signals employed in the intrusion detection apparatus of the present invention.

The unmodulated carrier supervisory signal transmitted from the transmitter 135 is received by the input transformer 180 (FIG. 7) via terminals FG (FIGS. 6 and 7), and is amplified by an amplifier 181 (FIG. 7). A tone decoder 182 produces an output signal from the unmodulated carrier, which is latched through a latch circuit 183 for application to a driver amplifier 184 through an inverter 184'. The driver amplifier 184 produces an output voltage to operate a suitable audio alarm 185. The unmodulated carrier causes the driver amplifier 184 to inhibit the audio alarm 185 from operating. The audio alarm 185 operates when there is an absence of the carrier frequency.

The selected zone signals $F_1$, $F_2$ and $F_3$ generated by the oscillator 145 (FIG. 6) and transmitted by the transmitter 135 are produced in the secondary winding 180B of the input transformer 180. Connected to the output of the amplifier 181 are tone decoders 190–192. The output signals from the tone decoder circuits 190–192 are latched through latch circuits 200–202, respectively, and applied to a 7-segment decoder/driver circuit 205. The tone decoders 190–192 detect, respectively, the zone signals $F_1$–$F_3$. The output of the 7-segment decoder/driver 205 is applied to a 7-segment light emitting diode display 206 to indicate the zone or location of the activated intruder location detection sensors.

The frequency modulated carrier transmitted by the transmitter 35 and received by the input transformer 180 is amplified by an amplifier 207 and filtered by a bandpass filter 208. The filtered signal is demodulated by a demodulating circuit 209. The demodulated audio signal passes through a low pass filter 210 and is amplified by an amplifier 211. The amplified audio signal is applied to a suitable speaker 212.

An operator actuating a button 215 excites an oscillator 216 to generate a tone burst signal. The tone burst signal is amplified by an amplifier 217 to excite a primary winding **180*c* of the transformer 180. The amplified tone burst is induced in a secondary winding 161*c* of the transformer 161 (FIG. 6) via the terminals F-G (FIGS. 6 and 7). The secondary winding 161*c* is connected to a bandpass filter 220 (FIG. 6). The filtered signal is amplified by an amplifier 221 and decoded by a tone decoder 222. The output of the tone decoder 222 is buffered by a buffer 223 and a reset signal is conducted to the signal processor 31 (FIG. 1) via the terminal H (FIGS. 1 and 6). The reset signal resets the output latch 73. In turn, the resetting of the output latch 73 advances a clock enable signal through the clock control NOR gate to operate the clock generator 45**.

The operation of the clock generator 45 applies clock pulses to the BCD counter 46. The BCD/decimal decoder 110 in response to the output of the BCD counter 46 actuates the zone reset switch 71 to advance a counter reset pulse through the AND gate 70 to reset the BCD counter 46. The signal processor 31 is now reset. Actuation of the reset switch 216 resets the latch circuits 183 and 200–202 of the display circuit 175.

In the event an operator elects to use less than the maximum number of zones, then the multiplexers 35 and 40 would scan idle or unused conductors. The multiplexers 35 and 40 in detecting an unused or idle conductor would sense a zero voltage thereon, unless the unused or idle conductors were biased. In the apparatus of the present invention, the unused or idle conductors are biased to the same voltage level as each of the preamplifiers 20–22 is biased. Thus, the level shifts between active and idle conductors are avoided by biasing or offsetting the active and idle conductors to the same voltage level.

I claim:

1. Intrusion detection apparatus comprising:

(a) a plurality of intrusion detection sensors connected to a first signal line;

(b) a plurality of discriminator sensors connected to a second signal line, said first and second signal lines being in the same cable; and (c) means connected to said intrusion detection sensors and said discriminator sensors and responsive to the activation of any one of said intrusion detection sensors but not more than a predetermined number of said discriminator sensors for operating an alarm.

2. Intrusion detection apparatus as claimed in claim 1 wherein said means comprises a signal processor, said signal processor comprising:

(a) an intrusion detection multiplexer for detecting signals emanating from said intrusion detection sensors and sequencing signals emanating from said intrusion detection sensors through said signal processor; and (b) a discriminator multiplexer for detecting signals emanating from said discriminator sensors and sequencing signals emanating from said discriminator sensors through said signal processor.

3. Intrusion detection apparatus as claimed in claim 2 wherein said signal processor comprises first circuit means responsive to signals from said intrusion detection multiplexer for establishing an alarm state signal, and wherein said signal processor comprises second circuit means responsive to the signals from said discriminator multiplexer for inhibiting said first circuit means for establishing an alarm state signal during the presence of a non-intruder signal.

4. An intrusion detection apparatus as claimed in claim 3 wherein said first circuit means includes a timing circuit and said second circuit means includes a timing circuit to inhibit the establishment of the alarm state signal after the cessation of a false alarm signal.

5. Intrusion detection apparatus as claimed in claim 2 wherein said signal processor comprises a matrix connected to said intrusion detection sensors and said discriminator sensors and directing the signals from activated intrusion detection sensors to said intrusion detection multiplexer and directing signals from activated discriminator sensors to said discriminator multiplexer.

6. Intrusion detection apparatus as claimed in claim 5 and comprising a second plurality of discriminator sensors connected to a third signal line, said third signal line being in the same cable as said first and second signal line, and wherein said discriminator multiplexer senses said second and third signal lines and sequences simultaneously through said signal processor signals emanating from said second and third signal lines to reduce false alarms.

7. Intrusion detection apparatus as claimed in claim 2 wherein said signal processor includes clock generating means for applying stepping pulses to said intrusion detection multiplexer and said discriminator multiplexer, and said signal processor further including means disabling said clock generating means in response to a signal from at least one of said intrusion detection sensors to stop further scanning by said intrusion detection multiplexer and said discriminator multiplexer.

8. Intrusion detection apparatus comprising:

(a) a plurality of signal lines of intrusion detection sensors;

(b) a plurality of signal lines of discriminator sensors; and (c) means connected to said signal lines of intrusion detection sensors and said signal lines of discriminator sensors and responsive to the activation of any one of said intrusion detection sensors but not more than a predetermined number of said discriminator sensors for operating an alarm, (d) said means comprising a signal processor, (e) said signal processor comprising:

(1) an intrusion detection multiplexer for sensing successively said signal lines of intrusion detection sensors and advancing signals conducted over any one of said signal lines of intrusion detection sensors through said signal processor, and (2) a discriminator multiplexer for sensing signals emanating from said discriminator sensors over said signal lines of discriminator sensors and advancing signals conducted over signals lines of discriminator sensors through said signal processor.

9. Intrusion detection apparatus as claimed in claim 8 wherein said signal processor comprises a matrix connected to said signal lines of intrusion detection sensors and said signal lines of discriminator sensors and directing the signals from activated intruder detection sensors to said intrusion detection multiplexer and directing signals from activated discriminator sensors to said discriminator multiplexer.

10. Intrusion detection apparatus as claimed in claim 9 wherein said discriminator multiplexer scans simultaneously at least two of said signal lines of discriminator sensors.

11. Intrusion detection apparatus as claimed in claim 10 wherein said signal processor includes clock generating means for applying stepping pulses to said intrusion detection multiplexer and said discriminator multiplexer for scanning in synchronism one of said signal lines of intrusion detection sensors with two of said signal lines of discriminator sensors, and said signal processor further including means disabling said clock generating means in response to a signal from at least one of said intrusion detection sensors to stop further scanning by said intrusion detection multiplexer and by said discriminator multiplexer.

12. An intrusion detection apparatus as claimed in claim 11 and further comprising a communication link connected to said signal processor over which is carried a carrier frequency modulated by a signal representing the activation of at least one of said intrusion detection sensors.

13. An intrusion detection apparatus as claimed in claim 12 wherein said communication link carries a monitoring signal.

14. An intrusion detection apparatus as claimed in claim 9 wherein said monitoring signal is a non-modulated carrier.

15. Intrusion detection apparatus as claimed in claim 8 wherein said signal processor comprises first circuit means responsive to signals from said intrusion detection multiplexer for establishing an alarm state signal, and wherein said signal processor comprises second circuit means responsive to the signals from said discriminator multiplexer for inhibiting said first circuit means from establishing an alarm state signal during the presence of a non-intruder signal.

16. An intrusion detection apparatus as claimed in claim 15 wherein said first circuit means includes a timing circuit and said second circuit means includes a timing circuit to inhibit the establishment of the alarm state signal after the cessation of a false alarm signal.

17. An intrusion detection apparatus as claimed in claim 16 wherein said signal processor comprises:

(a) a zone identification circuit for producing zone identification signals, (b) clock generating means for applying pulses to said intrusion detection multiplexer for scanning signals over said signal lines of intrusion detection sensors and to said zone identification circuit for synchronizing zone identification signals with said intrusion detection multiplexer scanning signals over said signal lines of intrusion detection sensors, and (c) means disabling said clock generating means in response to a signal over any one of said signal lines of intrusion detection sensors to stop further scanning by said intrusion detection multiplexer and to hold said zone identification circuit at the last zone indicating signal.

18. An intrusion detection apparatus as claimed in claim 17 and comprising means responsive to said last zone indicating signal to generate a zone indication signal at a frequency indicative of the zone of the intrusion.

19. An intrusion detection apparatus as claimed in claim 17 and comprising means responsive to said last zone indicating signal to indicate the zone of the intrusion.

20. Intrusion detection apparatus comprising:

(a) a plurality of intrusion detection sensors;

(b) a plurality of discriminator sensors; and (c) means connected to said intrusion detection sensors and said discriminator sensors and responsive to the activation of any one of said intrusion detection sensors but not more than a predetermined number of said discriminator sensors for operating an alarm.

21. An intrusion detection apparatus as claimed in claim 20 wherein said means is responsive to the simultaneous activation of more than said predetermined number of said discriminator sensors for inhibiting the operation of the alarm.

* * * * *